US006796360B2

(12) United States Patent
Ferrie et al.

(10) Patent No.: US 6,796,360 B2
(45) Date of Patent: Sep. 28, 2004

(54) SHADE TENSIONER

(75) Inventors: Randy Ferrie, Granger, IN (US); Kermit Parsons, Three Rivers, MI (US)

(73) Assignee: Specialty Window Coverings, Elkhart, IN (US)

( * ) Notice: Subject to any disclaimer, the term of this patent is extended or adjusted under 35 U.S.C. 154(b) by 0 days.

(21) Appl. No.: 10/374,224

(22) Filed: Feb. 25, 2003

(65) Prior Publication Data

US 2004/0163775 A1 Aug. 26, 2004

(51) Int. Cl.[7] ..... E06B 9/327

(52) U.S. Cl. ..... 160/172 R; 160/84.06; 160/279

(58) Field of Search ..... 160/172 R, 168.1 R, 160/178.1 R, 84.06, 279; 24/127, 132 W, 135 R, 136 B, 716, 115 M

(56) References Cited

U.S. PATENT DOCUMENTS

| | | | |
|---|---|---|---|
| 1,616,881 | A | 2/1927 | Wharton |
| 1,639,278 | A | 8/1927 | Wharton et al. |
| 3,081,575 | A | 3/1963 | Meisner |
| 3,120,043 | A | 2/1964 | Henley |
| 3,597,808 | A | 8/1971 | Johnson |
| 3,818,624 | A | 6/1974 | Duffy |
| 4,199,890 | A | 4/1980 | Austin et al. |
| 4,513,524 | A | 4/1985 | Jolliff |
| 4,811,466 | A | 3/1989 | Zubli |
| 5,184,798 | A | 2/1993 | Wilson |
| 5,542,461 | A | 8/1996 | Huang |
| D395,973 | S | 7/1998 | Huang |
| 6,044,889 | A | 4/2000 | Liu |
| D424,924 | S | 5/2000 | Ackerman |
| D442,413 | S | 5/2001 | Ishii |

*Primary Examiner*—David Purol
(74) *Attorney, Agent, or Firm*—Foley & Lardner LLP

(57) ABSTRACT

A tensioner for securing a tension cord of a tension shade attached to a structure. The tensioner includes a lock component having an inner surface, an outer surface and an aperture extending therethrough. A casing includes an inner surface, an outer surface and an aperture extending therethrough, and an outer periphery defining a cavity for receiving the lock therein. The lock and the casing form a first and second opening and a path there between for receiving a portion of the tension cord. The opening forms an axis substantially perpendicular to an axis defined by the apertures of the lock and casing. A fastener extends through the apertures of the lock and casing to secure the lock and casing to the structure and to fix the location of the tension cord relative to the casing.

23 Claims, 3 Drawing Sheets

10
12
28
49
40
24
38
18
22
26
34
16
32
14
42
48
46
36
30
20
44
47

SHADE TENSIONER

CROSS-REFERENCE TO RELATED PATENT APPLICATIONS

None.

BACKGROUND OF THE INVENTION

The present invention relates generally to the field of window coverings and more particularly to a tensioner for a tension shade/blind. (hereinafter referred to as a (tension shade"). Window coverings typically include a headrail and a bottom rail movable toward and away from the headrail. A window covering material such as a pleated blind or a plurality of slats hang from the headrail and are operatively connected to the bottom rail. In the case of a pleated blind, a pleated material hangs from the headrail and is attached to the bottom rail. As the bottom rail is raised toward the headrail the pleated material accumulates on the bottom rail. In a traditional pleated blind, a lift cord is secured to the bottom rail and extends upward through the pleated material, into the headrail and through a cord lock. The bottom rail and pleated material are raised and lowered by pulling on the free end of the lift cord. In a venetian blind with slats, at least two ladders supporting the slats extend from the headrail and are operatively connected to the bottom rail. A lift cord connected to the bottom rail extends through the slats and headrail and is releasably secured in a cord lock.

In a tension shade the lift cord is replaced with tension cords that are connected to and extend from the headrail through the pleated material or slats, through the bottom rail and are secured under tension to a window frame or structure. The tension on the tension cords fix the location of the bottom rail relative to the headrail. The bottom rail is moved toward and away by a user simply pulling or pushing the bottom rail to the desired location. In order to maintain sufficient tension on the tension cords, a spring is often used in either the headrail or bottom rail, or located on the window sill or structure.

Once the tension is set and the blind is installed, the cords tend to give over a period of time and lose tension. If a spring is used, the spring can be overloaded during installation to ensure that there will be sufficient tension in the tension cords over the life of the blind.

Tension shades that are used in recreational vehicles are subject to more vibrations and movement then tension shades used in a fixed structure. As a result of the increased vibration and movement, the tension shades are more likely to lose tension over time. Accordingly, it is important to set the tension to the proper level upon installation to ensure optimal operation of the blind over time. One difficulty in setting the tension occurs when the tension cords are secured to the window frame or structure.

One such well known fastening device is illustrated in U.S. Pat. No. 6,044,889 in the tension cords 22, 26 are attached to a reel 23. The reel is secured to the wall thereby setting the tension on the tension cords. The tension cords are tied on to the reel like anchor. In order to tighten the tension on the cords the tension cord can be wrapped around the respective reel. (See col. 3 lines 8–15). There are a number of problems with this type of anchor. First, the anchor is typically formed from plastic and subject to breaking at the point at which the tension cord is tied on. When the anchor breaks, the entire shade is often returned to the manufacturer for replacement. Additionally, it is difficult to set the tension to the correct level when installing the anchor, since the cord is already attached with a knot. Additionally, incremental adjustment is achieved by wrapping the tension cord around the reel.

Accordingly, it would be desireable to provide a tensioner for use in a tension window covering that is easy to install and adjust and that is not subject to breaking.

SUMMARY OF THE INVENTION

One embodiment of the invention relates to a tension shade comprising a headrail supporting a window covering and a bottom rail operatively connected to the window covering. At least one tension cord extends from the headrail and is operatively connected to the bottom rail. At least one tensioner is connected to the tension cord and is configured to be releasably secured to a structure. The tensioner includes a first component having an engagement surface and a second component having a second engagement surface. The first component is configured to snap fit into the second component. The first and second components have a first position wherein the first engagement surface and the second engagement surface are spaced apart a predetermined distance sufficient to frictionally engage a portion of the tension cord. The first component is movable within the second component from the first position to a second fully engaged position to clamp the tension cord between the first and second engagement surfaces.

Another embodiment includes a tensioner for securing a tension cord of a tension shade attached to a structure. The tensioner includes a lock component having an inner surface, an outer surface and an aperture extending therethrough. A casing includes an inner surface, an outer surface and an aperture extending therethrough, and an outer periphery defining a cavity for receiving the lock therein. The lock and the casing form a first and second opening and a path therebetween for receiving a portion of the tension cord. The opening forms an axis substantially perpendicular to an axis defined by the apertures of the lock and casing. A fastener extends through the apertures of the lock and casing to secure the lock and casing to the structure and to fix the location of the tension cord relative to the casing.

In still another embodiment a method of installing a tension shade to a structure includes providing a tension shade with a headrail, a bottom rail, and a window covering operatively connected the headrail and bottom rail. A pair of tension cords extend from the headrail and are operatively contacting the bottom rail. A tensioner is attached to each respective tension cord with sufficient friction to locate each tensioner an the tension cord and is slidably movable along each respective tension cord with the application of force. A first tensioner is secured to the structure with a fastener and the tensioner is clamped to one of the tension cords with sufficient force prohibiting movement of the tension cord relative to the first tensioner. A second tensioner is attached to the structure with a a second fastener. The other tension cord is moved relative to the second tensioner to provide sufficient tension on the tension cord to maintain the location of the bottom rail to the headrail and any location of the bottom rail between a fully raised position where the bottom rail is proximate the headrail and a fully lowered position where the bottom rail is distal the headrail. Finally, the second tensioner is fully secured to the structure with sufficient force to prohibit movement of the tension cord relative to the first tensioner.

DETAILED DESCRIPTION OF THE PREFERRED EMBODIMENTS

Figures 1, 2:
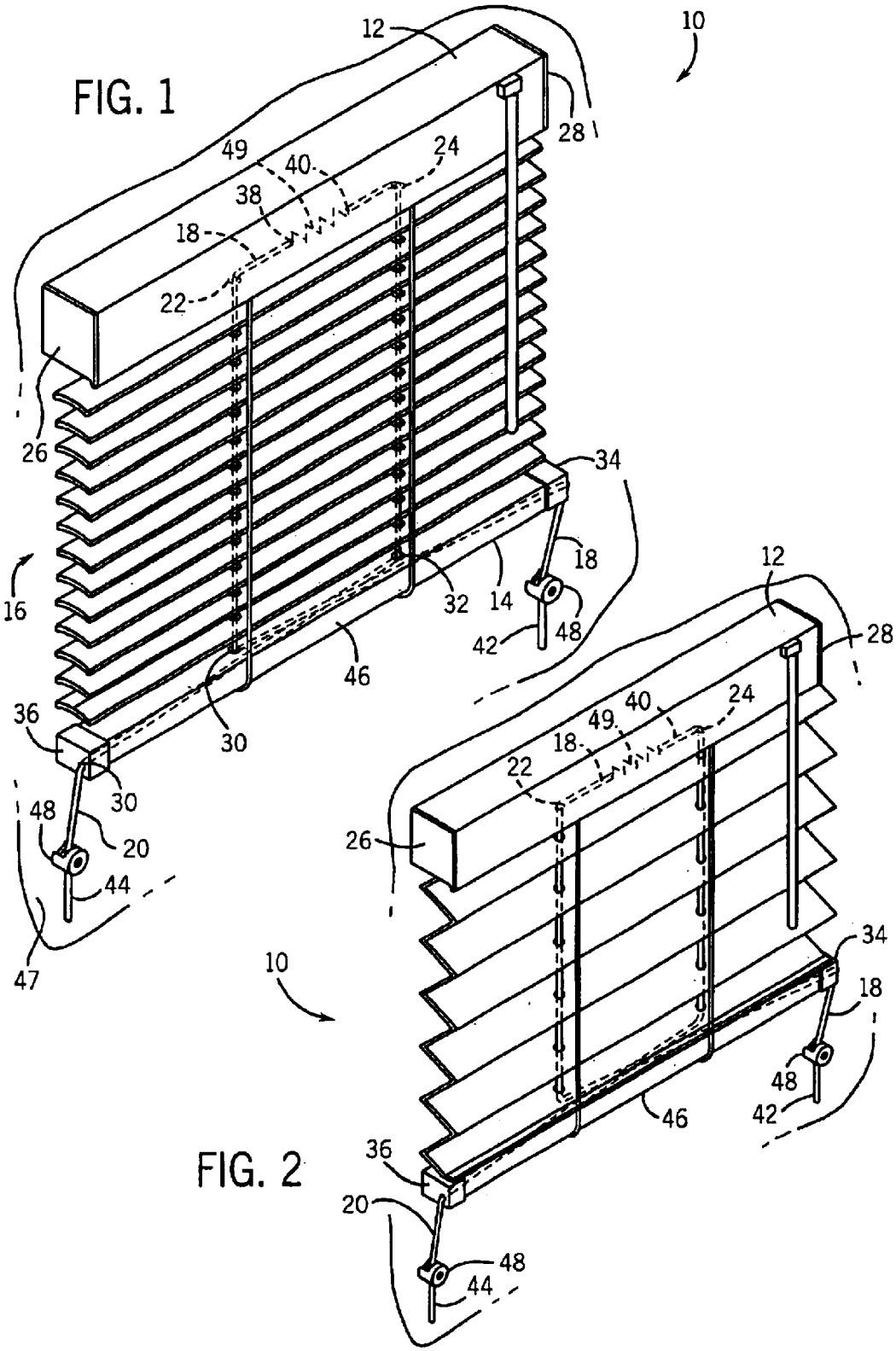
FIG. 1 is a first tension shade with a tensioner.
FIG. 2 is a second tension shade with a tensioner
Figure 3:
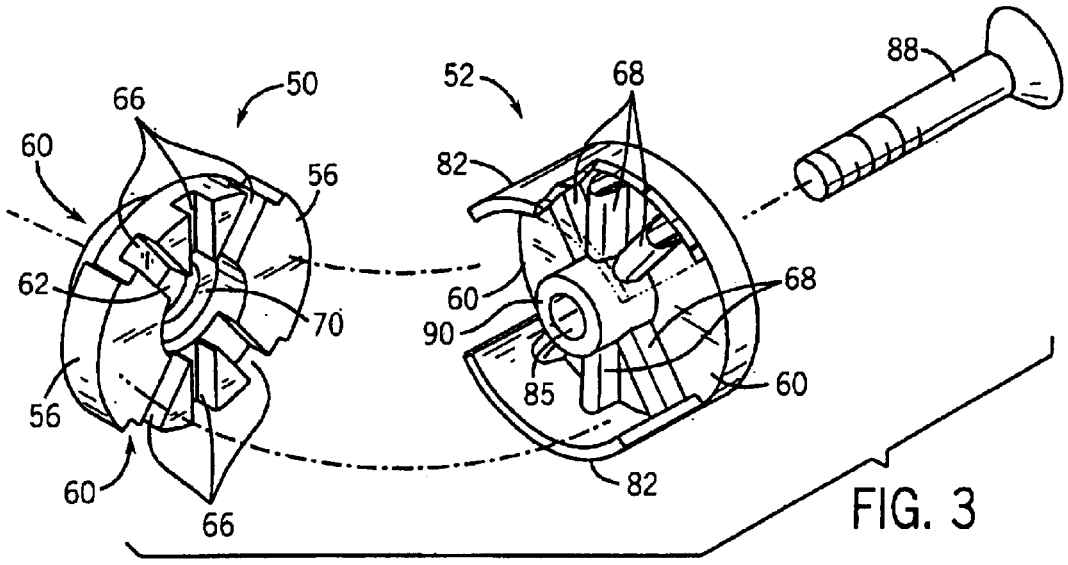
FIG. 3 is an exploded perspective view of the tensioner
Figure 4:
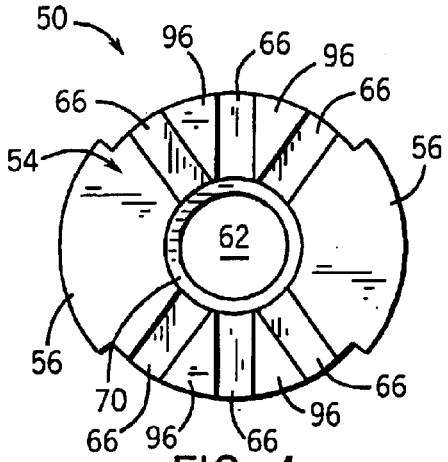
FIG. 4 is an inner view of one of the tensioner halves.
Figure 5:
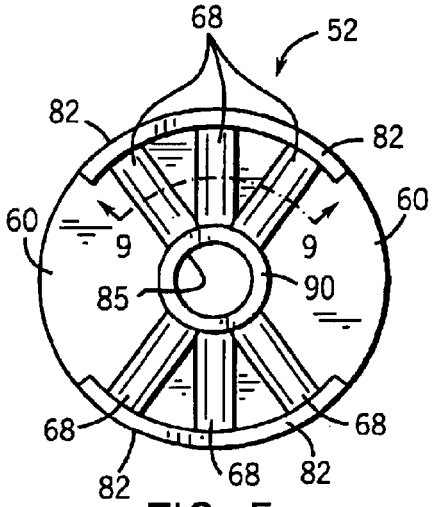
FIG. 5 is an inner view of the other of the tensioner halves.
Figure 6:
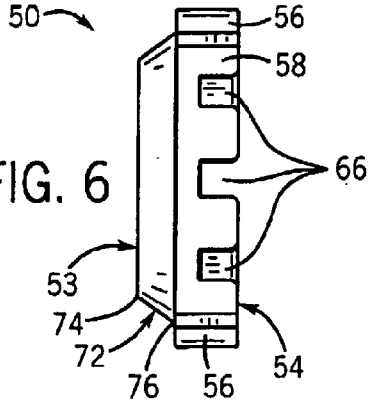
FIG. 6 is a side view of one of the tensioner halves.
Figure 7:
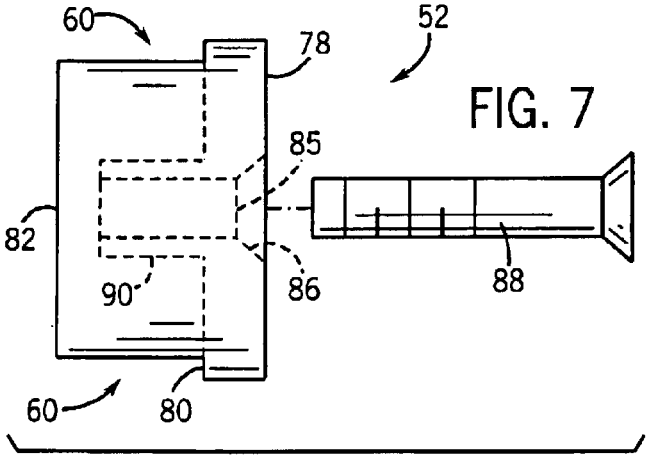
FIG. 7 is a side view of the other of the tensioner halves.
Figure 8:
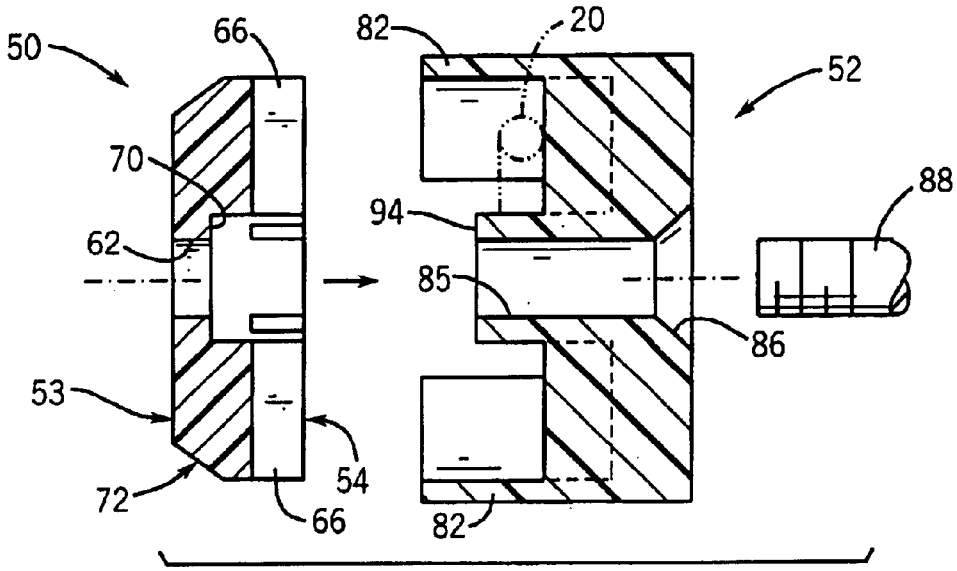
FIG. 8 is an exploded side view of the tensioner.

Referring to FIGS. 1 and 2, a tension shade 10 includes a headrail 12, a bottom rail 14, and a window covering 16 extending therebetween. A first and second tension cord 18, 20 is operatively connected to headrail 12. First and second tension cords 18, 20 extend through a respective first and second openings 22, 24 in headrail 12 proximate a first and second sides 26, 28 of headrail 12. Tension cords 18, 20 extend through window covering 16 and enters into the respective first and second openings 30, 32 in bottom rail 14, and exit through the respective opposite ends 34, 36 of bottom rail 14.

Tension cords 18, 20 have a respective first end 38, 40 and a respective second end 42, 44. Cords 18, 20 cross one another in the center portion 46 of bottom rail 14. Each tension cord 18, 20 is secured to a window frame or structure 47 with a shade tensioner 48. In the preferred embodiment, first ends 38, 40 are secured to a tension spring 49 located within headrail 12. Spring 49 applies a continuous force to tension cords 18, 20 to provide and equalize tension within the cords.

Referring to FIGS. 3–8, tensioner 48 includes a locking portion (or lock) 50 that interacts with an outer casing portion (or casing) 52. Lock 50 includes an outer surface 53 that is in direct contact with a window casing or wall structure when secured thereto and also includes an inner surface 54 opposite outer surface 53. A pair of tabs 56 extend from an outer periphery 58 of lock 50 that are received in corresponding openings 60 of casing 52. An opening 62 extends through lock 50 and includes a counter bore 64 having a diameter larger than opening 62 and extending a predetermined distance from inner surface 54 toward outer surface 52. An annular stop region 70 is defined by the counter bore 64. A plurality of grooves 66 extend inward from inner surface 54 and are aligned with a plurality of ribs 68 described below in casing 52. In the embodiment illustrated in FIGS. 2 and 3, there are six grooves and six ribs. However, other numbers of grooves and/or ribs may be used. Extending from outer surface 53 is a beveled surface 72 having an upper edge 74 adjacent outer surface 53 and a lower edge 76 adjacent outer periphery 58 and tabs 56.

Casing 52 includes an outer surface 78 and an opposing inner surface 80 that faces the window sill or structure when installed. A pair of side walls 82 define openings 60 and form the outer periphery of casing 52. An aperture 85 extends through casing 52. A beveled counter bore 86 extends inward from outer surface 78 to receive the beveled head of screw 88 that will secure the tensioner 48 to the window sill or structure. A hollow bearing 90 extends toward the free edge 92 of walls 82 a predetermined distance, such that when lock 50 is located within casing 52 an end 94 of bearing 90 abuts the inner surface 70 of counter bore 64. When bearing 90 abuts the inner surface 70 of counter bore 64, ribs 68 are proximate the openings of the corresponding six grooves 66 on lock 50.

The installation of tension shade 10 will now be described. Headrail 12 of tension shade 10 is secured to a window sill or wall structure with a pair of brackets (not shown). A tensioner 48 is attached to each tension cord 18, 20 a distance from the respective ends 42, 44, but between ends 42, 44 and the openings 34, 36 of bottom rail 14. Tension 48 is attached to tension cords 18, 20 by placing a portion of cords 20, through openings 60 of outer casing 52. A first portion of cord 20 is placed through openings 60 of one outer casing 52 such that the portion is located between bearing 90 and side walls 82 of casing 52. The lock 50 is inserted into casing 52 such that the portion of cord 20 is captured between ribs 68 and raised portions 96 that are defined by the area between grooves 66.

Lock 50 snap fits into casing 52 to releasably retain lock 50 within casing 52. By design there is a clearance between the ribs 66 and raised portions 96 when lock 50 is snap fits into casing. 52. Since the tension cord 20 is thicker than the clearance between the ribs 66 and raised portions 96 there is sufficient interference between tension cord 20 and the tensioner 48 that tension cord 20 is held into place. However, cord 20 may be further compressed so it is possible to adjust the location of tensioner 48 along tension cord 20 without releasing lock 50 from casing 52. Lock 50 may be snap fit into casing 52 in a number of ways. Casing 52 may include an inwardly extending lip proximate the end of side walls 82 that hold lock 50 in place once the lower edge 76 clears the lip. Alternatively, there may be a friction fit between the side walls and the outer periphery of lock 50 to frictionally engage the two halves until fastener 88 fully secures the two components together.

Figure 9:
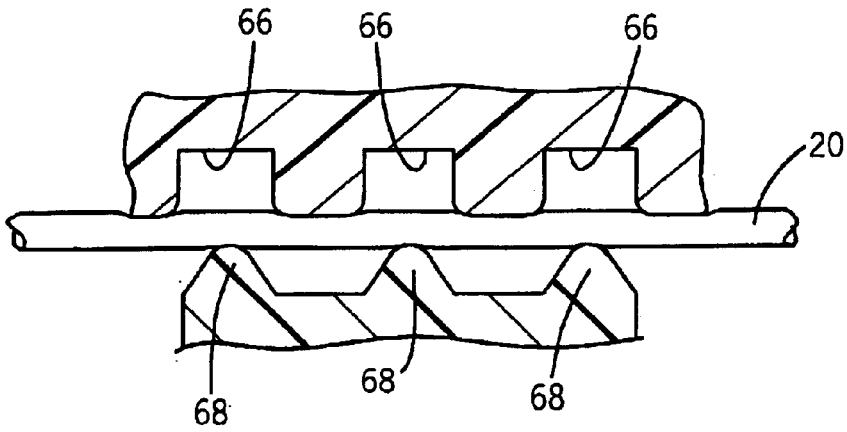
FIG. 9 is a cross sectional view of the tensioner in a first position taken generally along lines 9—9 of FIG. 5.

In one embodiment, first tensioner is attached to one of the tension cords 18, 20 a distance of one half inch from the bottom rail when the bottom rail is in a lowered positions. The lowered position is defined as the position the blind material is in when the window area is fully covered. In contrast the upper position is the position of the blind material when the window is fully exposed, or the bottom rail is moved as close to the headrail as possible. The second tensioner is applied to the other tension cord 20, 18 a distance greater than one half inch from the bottom rail when the bottom rail is in the lowered position. The tensioners are applied to the tension cord 18, 20 such that each lock 50 is snap fit within a respective casing 52 capturing a potion of tension cords 18, 20 therebetween. In this first snap fit position, shown in FIG. 9, it is still possible to move the tensioner along the tension cords by simply pulling the tensioner along the tension cords.

Figure 10:
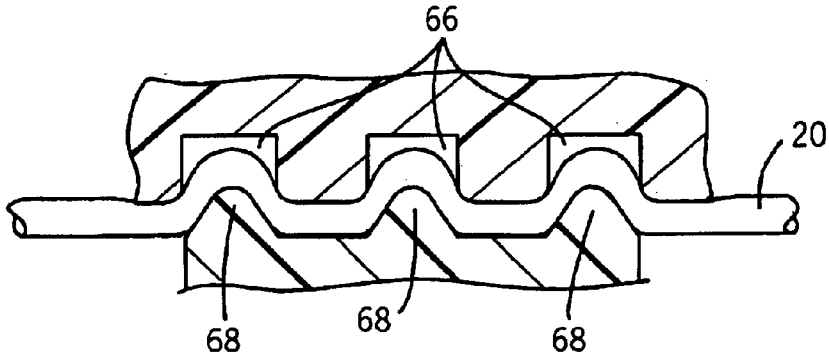
FIG. 10 is a cross sectional view of the tensioner in a second position taken generally along lines 9—9 of FIG. 5.

A fastener 88 such as a screw is inserted into opening 85, through the bearing, 90 and through opening 62 in lock 50. The fastener 88 is then screwed into the window frame sill or wall structure to secure the tensioner to the sill or wall. Referring to FIG. 10, a portion of cord 20 is captured between lock 50 and casing 52. Next a second tensioner 48 is attached to the window frame or wall structure and secured with a fastener such as a screw. As the fastener secures tensioner 48 to the wall lock 50 and casing 52 are tightened relative to one another capturing the second tension cord 18 therebetween. Lock 50 can be moved into casing 52 until the end 94 of bearing 90 contacts the inner surface 70 of counter bore 64.

Once the first tensioner is fully secured to the window frame or wall, the second tensioner is secured to the window frame or wall by a fastener. Prior to fully securing the second tensioner the bottom rail is moved upward from its bottom position. The installer pulls downward on the second tension cord to ensure proper tension on the cords and then fully anchors the tensioner locking the tension cord in place. Since, spring 49 applied tension to both cords 18 and 20, the tension in the cords is equalized. Once there is sufficient tension on the system, the second tensioner 48 is fully secured to the wall and lock 50 is moved sufficiently within casing 52 so that tension cord 18 is clamped within the tensioner 48. If over time, the tension cord stretches or spring 49 begins to creep sufficient tension can be added to tension cords 18, 20, by simply loosening one of the tensioners pulling the respective tension cord through the tensioner until there is sufficient tension in the system and subsequently tightening the tensioner.

It will be understood that the above description is exemplary embodiments and that the invention is not limited to the specific embodiments described. Various substitutions, modifications, changes, and omissions may be made in the arrangement of the elements without departing from the scope of the invention as expressed in the appended claims.

What is claimed is:

1. A tension shade comprising:

a headrail supporting a window covering;

a bottom rail operatively connected to the window covering;

at least one tension cord extending from the headrail and operatively connected to the bottom rail;

at least one tensioner connected to the tension cord and configured to be releasably secured to a structure;

the tensioner including a first component having an engagement surface and a second component having a second engagement surface; a portion of the first component interfering with a portion of the second component inhibiting the first and second components from separating, the first and second components having a first position wherein the first engagement surface and the second engagement surface are spaced apart a predetermined distance sufficient to frictionally engage a portion of the tension cord, the first component being movable within the second component from the first position to a second fully engaged position clamping the tension cord between the first and second engagement surfaces.

2. The tension shade of claim 1, wherein the first and second components define a first and second opening through which a portion of the tension cord passes.

3. The tension shade of claim 2, further including a fastener for releasably securing the tensioner to the structure.

4. The tension shade of claim 3, wherein the fastener is a screw that moves the first and second components from the first position to the second fully engaged position.

5. The tension shade of claim 4, wherein the second component includes a hollow bearing for receiving the fastener; the hollow bearing having a free end which contacts a surface of the first component to positively limit the movement of the first and second components.

6. The tension shade of claim 5, wherein the first component has an outer surface that is in contact with the structure when secured thereto, the outer surface being coplanar with an edge of the second component when the first and second components are fully engaged.

7. The tension shade of claim 6, wherein there are two tension cords and two respective tensioners.

8. The tension shade of claim 7, wherein a single spring is attached to both tension cords.

9. The tension shade of claim 1, wherein the portion of the first component includes a side wall having an inwardly extending lip that hold the second component in place once a portion of the second component clears the lip.

10. The tension shade of claim 1, wherein a portion of the first component frictionally engages a portion of the second component.

11. A tension shade comprising:

a headrail supporting a window covering;

a bottom rail operatively connected to the window covering;

at least one tension cord extending from the headrail and operatively connected to the bottom rail;

at least one tensioner connected to the tension cord and configured to be releasably secured to a structure;

the tensioner including a first component having an engagement surface and a second component having a second engagement surface; the first and second components having a first position wherein the first engagement surface and the second engagement surface are spaced apart a predetermined distance sufficient to frictionally engage a portion of the tension cord, the first component being movable within the second component from the first position to a second fully engaged position clamping the tension cord between the first and second engagement surfaces;

the first and second components defining a first and second opening through which a portion of the tension cord passes; and wherein the first engagement surface includes at least one raised region.

12. The tension shade of claim 11, wherein the raised region is a rib.

13. A tensioner for securing a tension cord of a tension shade attached to a structure, the tensioner comprising:

a lock component having an inner surface, an outer surface and an aperture extending therethrough;

a casing including an inner surface, an outer surface and an aperture extending therethrough, and an outer periphery defining a cavity for receiving the lock therein;

the lock and the casing forming a first and second opening and a path therebetween for receiving a portion of the tension cord, the opening forming an axis substantially perpendicular to an axis defined by the apertures of the lock and casing; and a fastener having a longitudinal axis and extending through the apertures of the lock and casing to secure the lock and casing and to the structure and to fix the location of the tension cord relative to the casing and lock.

14. The tensioner of claim 13, wherein the casing and lock are configured to snap fit together in a first position and frictionally engage the tension cord.

15. The tensioner of claim 14, wherein the frictional fit is sufficient to retain the casing and lock at a specific position along the tension cord and movable along the tension cord with the application of force.

16. The tensioner of claim 15, wherein the lock is movable within the casing form the first position to a second fully engaged position clamping the tension cord between the first and second engagement surfaces.

17. The tensioner of claim 16, wherein the first engagement surface includes at least one raised cavity.

18. The tensioner of claim 17, wherein the casing includes a hollow bearing for receiving the fastener, the hollow bearing having a free end which contacts a surface of the lock to positively set the lock and casing in the second fully engaged position.

19. A method of installing a tension shade to a structure comprising:

providing a tension shade having a headrail, a bottom rail, and a window covering operatively connected to the headrail and bottom rail; a pair of tension cords extending from the headrail and operatively contacting the bottom rail;

attaching a first and second tensioner to each respective tension cord with sufficient friction to locate each tensioner on the tension cord and slidably movable along each respective tension cord with the application of force;

securing the first tensioner to the structure with a fastener and clamping the first tensioner to one of the tension cords with sufficient force prohibiting movement of the tension cord relative to the first tensioner;

securing the second tensioner to the structure with a fastener;

moving the other tension cord relative to the second tensioner to provide sufficient tension on the tension cord to maintain the location of the bottom rail to the headrail and any location of the bottom rail between a fully raised position where the bottom rail is proximate the headrail and a fully lowered position where the bottom rail is distal the headrail;

fully securing the second tensioner to the structure with sufficient force to prohibit movement of the tension cord relative to the second tensioner;

wherein securing the tensioners to the tension cords, includes engaging a portion of the first component with a portion of the second component inhibiting the first and second components from separating, a first and second component together about the tension cord;

adjusting the tension in the tension shade by loosening the fastener of one of the tensioners; and modifying the tension on the tension cord by moving the tension cord relative to the tensioner and fully securing the tensioner to the structure with the fastener.

20. The method of claim 19, wherein securing the tensioners to the tension cords, includes snap fitting the first and second component together about the tension cord.

21. The method of claim 19, further including adjusting the tension in the tension shade by loosening the fastener of one of the tensioners; and modifying the tension on the tension cord by moving the tension cord relative to the tensioner and fully securing the tensioner to the structure with the fastener.

22. The method of claim 21, further including, operatively connecting each tension cord with a single spring to equalize the tension in both tension cords.

23. The method of claim 19, wherein engaging a portion of the first component with a portion of the second component and inhibiting the first and second components from separating, includes providing an inwardly extending lip on one of the first and second components that engages an edge on the portion of the other of the first and second components.

* * * * *